US005671000A

United States Patent [19]

Hirabayashi et al.

[11] Patent Number: 5,671,000

[45] Date of Patent: Sep. 23, 1997

[54] INK JET CARTRIDGE WITH SEPARATELY EXCHANGEABLE INK TANK AND RECORDING HEAD

[75] Inventors: Hiromitsu Hirabayashi, Yokohama; Shigeyasu Nagoshi, Kawasaki; Noribumi Koitabashi; Hitoshi Sugimoto, both of Yokohama; Miyuki Fujita, Tokyo; Fumihiro Gotoh; Masaya Uetsuki, both of Kawasaki, all of Japan

[73] Assignee: Canon Kabushiki Kaisha, Tokyo, Japan

[21] Appl. No.: 277,589

[22] Filed: Jul. 20, 1994

[30] Foreign Application Priority Data

Jul. 21, 1993 [JP] Japan ..... 5-180187

[51] Int. Cl.[6] ..... B41J 2/175

[52] U.S. Cl. ..... 347/86; 347/50

[58] Field of Search ..... 347/86, 87, 85, 347/50, 49

[56] References Cited

U.S. PATENT DOCUMENTS

| | | | |
|---|---|---|---|
| 4,156,244 | 5/1979 | Erikson et al. | 347/86 |
| 5,119,115 | 6/1992 | Buat et al. | 347/86 |
| 5,162,817 | 11/1992 | Tajika et al. | 346/140 R |
| 5,182,581 | 1/1993 | Kashimura et al. | 346/140 R |
| 5,185,615 | 2/1993 | Koitabashi et al. | 346/1.1 |
| 5,237,342 | 8/1993 | Saikawa et al. | 346/140 R |
| 5,245,361 | 9/1993 | Kashimura et al. | 346/140 R |
| 5,289,213 | 2/1994 | Murai et al. | 346/140 R |
| 5,448,274 | 9/1995 | Hirabayshi et al. | 347/50 |

FOREIGN PATENT DOCUMENTS

| | | | |
|---|---|---|---|
| 178051 | 7/1990 | Japan | 347/49 |
| 193451 | 8/1991 | Japan | 347/50 |
| 4247954 | 9/1992 | Japan | 347/29 |

*Primary Examiner*—N. Le

[57] ABSTRACT

An ink jet cartridge, removably mountable on an ink jet recording apparatus, includes a recording head and an ink tank containing recording liquid. The head and cartridge are removably connected through an engaging member provided on the ink tank and an engaged member provided on the recording head. When the ink tank and the recording head are not combined, a protecting cover provided on the recording head can protect sensitive components of the recording head, while partially overlapping the side of the link tank and being integrated therewith when the recording head and ink tank are combined.

12 Claims, 7 Drawing Sheets

INK JET CARTRIDGE WITH SEPARATELY EXCHANGEABLE INK TANK AND RECORDING HEAD

BACKGROUND OF THE INVENTION

1. Field of the Invention

The present invention relates to a detachable and exchangeable ink jet cartridge usable with an ink jet recording apparatus, and more particularly to an ink jet cartridge comprising an ink tank and a recording head both of which can be exchanged.

2. Description of the Related Art

A conventional ink jet recording apparatus frequently comprises a recording head which can be used in a semi-permanent manner, and an exchangeable ink cartridge for supplying ink to the recording head. However, since it is difficult to completely eliminate trouble such as clogging of discharge openings in the head or deterioration of ejection-energy generating elements, there can be a problem with the reliability of the ink jet recording apparatus, thus requiring a special maintenance service system for maintaining recording performance. Conventionally, an exchange type head cartridge can be periodically checked at predetermined intervals to provide improvement in the reliability of the apparatus. An ink tank is typically integrated with the recording head so that when the recording head is changed, the new recording head is provided with a predetermined amount of ink.

However, in such an integral ink cartridge, the amount of ink included in the ink tank is not large because the head often must be changed before the ink runs out for the purpose of maintaining reliability and because the size and weight of the ink cartridge will unduly increase if it includes too much ink. When the ink is used up, even if the recording head is still operable, however, the recording head must be changed together with the ink tank. This can cause environmental problems relating to the disposal of the cartridges. Thus, an ink jet recording apparatus has recently been proposed in which the characteristics of an exchangeable ink cartridge are effectively employed in respect to reliability, but the recording head an the ink tank are designed so as to be independently exchangeable to minimize increases in the running coat of the apparatus and its effects on the environment. Particularly, importance is attached to providing a recording apparatus in which an ink tank and a recording head are combined on a carriage to that ink can effectively be supplied to the recording head and discharged as ink droplets to a recording medium.

Exchange of such an ink tank or recording head requires properly reconnecting the ink supply passages of the ink tank and the recording head, properly mounting and fixing the recording head to a carriage for scanning the recording head to record an image, and making proper electrical connections or supplying electric power or a recording signal to the recording head. In regard to the electrical connections, since the circuit of the recording head or the body of the recording apparatus can sometimes be broken due to electrostatic impact to the contact point of the recording head or the recording apparatus during exchange, it is important to prevent this problem. In regard to the connection of the ink passages, although the use of solid ink can cause problems, the use of liquid ink is particularly troublesome because of the need to prevent the inside of the apparatus, the recording paper or the operator's hands from being stained by ink leaking from the connection portion, and the need to prevent damage to the filter provided between the ink tank and the recording head for preventing contamination of liquid ink in the recording head with foreign material and bubbles. Particularly in regard to the connection of the ink passages, the above problems make it desirable to provided both a secure connection and a simple connecting/disconnecting structure, from the viewpoint of the ease of exchanging the ink tank, but both requirements cannot be easily satisfied by simple structure. In addition, since the size of such recording apparatus, including the recording head and the ink tank, is being made smaller and smaller, handling the recording head and the ink tank is more difficult.

SUMMARY OF THE INVENTION

Accordingly, an object of the present invention is to solve the above problems and provide an ink jet cartridge and a recording apparatus provided with the cartridge in which an ink tank is securely combined with a recording head, and the ink tank can easily be exchanged.

In accordance with one aspect of the present invention, an ink jet cartridge is removably mountable on a recording apparatus and has a recording head for discharging a recording liquid onto a recording medium and a tank for storing recording liquid to be supplied to the recording head for discharge thereby, wherein the recording head and the tank are removably connectable to each other and include engaging means for orienting the recording head and tank reliable to each other in a predetermined fixed orientation when connected to each other, the recording head includes at least one operational component that cooperates with the tank when the recording head and the tank are connected to each other and a protective cover disposed to shield the operational component when the recording head and the tank are detached from each other, and the protective cover at least partially overlaps the tank when the recording head and the tank are connected to each other.

In accordance with another aspect of the invention, an ink jet recording apparatus comprises an ink jet cartridge including a recording head for discharging ink onto a recording medium and a tank for storing recording liquid to be supplied to the recording head for discharge thereby, wherein the recording head and the tank are removably connectable to each other and include engaging means for orienting the recording head and tank relative to each other in a predetermined fixed orientation when connected to each other, the recording head includes at least one operational component that cooperates with the tank when the recording head and the tank are connected to each other and a protective cover disposed to shield the operational component when the recording head and the tank are detached from each other, and the protective cover at least partially overlaps the tank when the recording head and the tank are connected to each other, and a carriage for scanning the cartridge relative to the recording medium, wherein the carriage includes means for removable securing the cartridge to the carriage by clamping the recording head between the tank and the carriage.

The present invention thus permits the recording head and the tank to be separately exchanged i an improved manner, and operational components, such as a printed circuit board, electrodes and connections with the tank can be protected by the protective cover of the recording head.

DESCRIPTION OF THE PREFERRED EMBODIMENT

Embodiments of the present invention are described in detail below with reference to the drawings.

(Embodiment 1)

Figure 1:
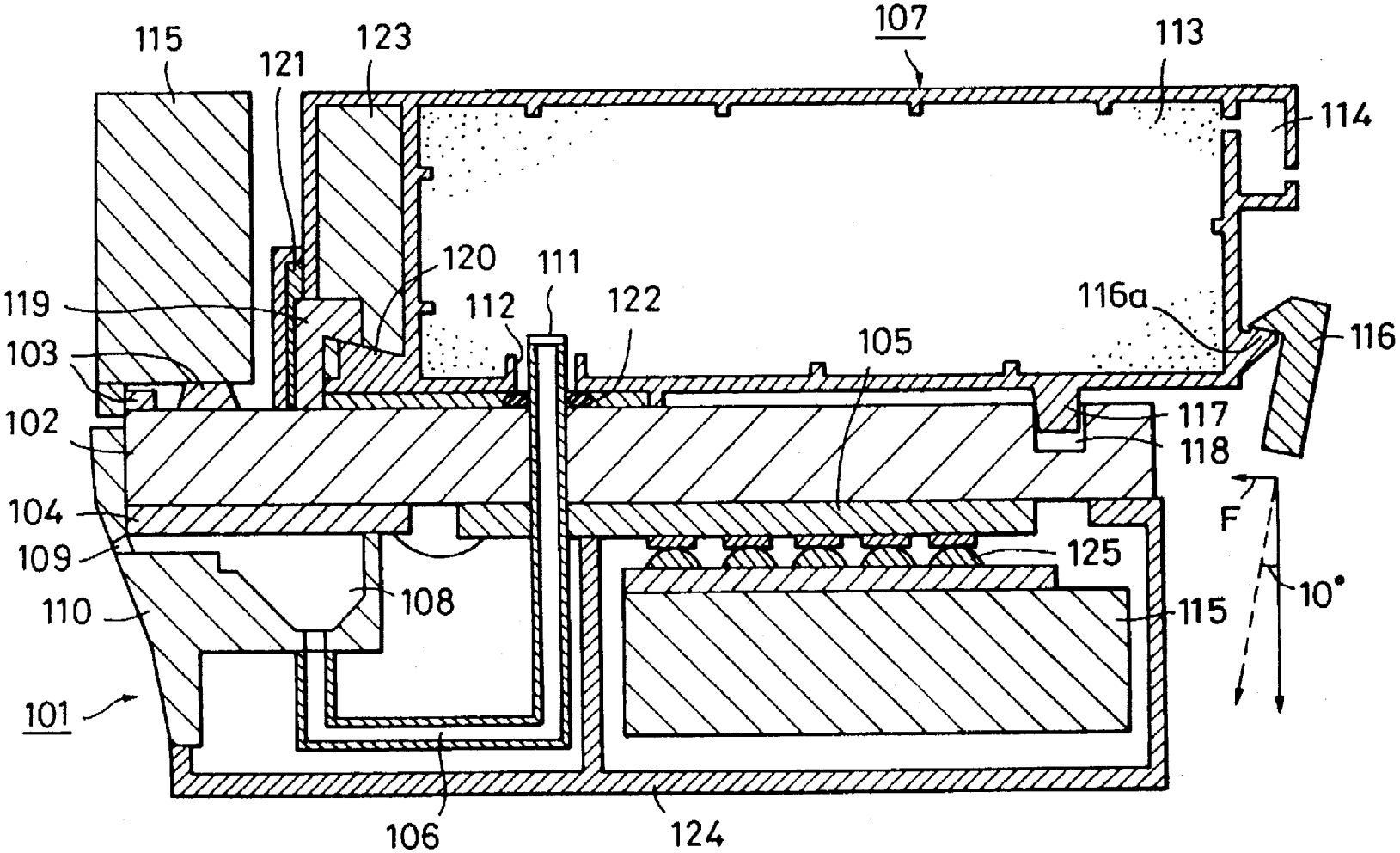
FIG. 1 is a schematic sectional view illustrating a first embodiment of the present invention.

FIG. 1 is a schematic sectional view of an ink jet recording apparatus in accordance with a first embodiment of the present invention.

FIG. 1 illustrates the state where a recording head, an ink tank and a cartridge are combined.

In this embodiment, the recording head is an ink jet recording system which uses an electrothermal conversion element generating thermal energy for producing film boiling in the ink in accordance with an electric signal. In FIG. 1, all main components of a recording head 101 are laminated on a head base plate 102 by bonding or contact bonding using as a positional reference a head positioning portion 103 and a notch provided on the head base plate 102. On a heater board 104 are formed, by a film forming technique, electrothermal conversion elements (discharge heaters) which are arranged in a plurality of lines on a Si substrate, with electrical wiring of Al or the like for supplying electric power to the conversion elements. The heater board 014 is connected by wire bonding to a recording head printed circuit board 105 (referred to as "PCB" hereinafter) having wiring and pads at the end thereof so as to receive electric signals from the apparatus body. A grooved to board 110 has partitions for respectively partitioning a plurality of ink passages corresponding to the discharge heaters, a liquid chamber 108 for introducing the ink supplied from an exchange ink tank 107 through an ink passage 106, and an orifice having a plurality of discharge openings 109. The partitions, the ink chamber 108 and the orifice are integrally formed by polysulfone or the like. The grooved to board 110 is pressed on the heater board 104 by a spring (not shown), contact-bonded, fixed and sealed by a sealing compound to form an ink discharge portion. The passage 106 bonded and sealed to the grooved top board 110 is passed through holes provided in the PCB 105 and the head base plate 102 to extend to the opposite side of the head base plate 102 so that the passage 106 can be connected to the exchange ink tank 107. A filter 111 is provided at the end of the passage 106 at the connection between the passage 106 and the exchange ink tank 107 to prevent dust and undesirable bubbles from flowing to the discharge openings 109. Further, a head cover 124 is provided for protecting the discharge portion and the pads for electrical connection of the recording head 101 and for facilitating handling of the recording head 101.

The exchange ink tank 107 has a tank case which has a tank guide provided on the inside thereof and which is filled with an ink absorber 113 impregnated with the ink with substantially no space, an ink supply port 112 in which the passage end provided with the ink filter 111 of the recording head 101 is inserted for ink connection, and an air communicating portion 114 for introducing into the ink tank 107 air in an amount corresponding to the outflow of the ink from the exchange ink tank 107, to prevent the occurrence of excessive negative pressure therein. The inner wall of the tank is ribbed, and the air communicating portion 114 is disposed at as a large distance as possible from the ink supply port in order to prevent air from communicating directly with the ink supply port 112 along the inner wall of the tank case and to effectively use the ink over the entire region of the ink absorber 113 to the upmost limit through capillary force. The ribs also function as reinforcing members for the tank case, and thereby facilitate exchange of the tank. The initial amount of the ink with which the ink absorber 113 is impregnated is determined so as to apply negative head pressure to the meniscus of the discharge openings 109, stably discharge the ink at the time of combination with the recording head 101, and prevent the ink from leaking even if a small impact is applied during exchange of the exchange ink tank 107. For these purposes, the ink is charged in an amount slightly smaller than the absorption capacity of the ink absorber 113. The ink absorber 113 proximate to the air communicating portion 114 may be subjected to liquid repellent treatment or formed by using another liquid repellent absorber so that the leakage of the ink from the air communicating portion 114 is restricted. The supply limit of the ink of the exchange ink tank 107 is determined by the state where the ability to supply the ink to the recording head by the capillary force of the nozzles accompanying the discharge of the ink is smaller than the ink absorption force of the ink absorber 113 due to the decrease in the amount of the ink impregnating the ink absorber 113, or the state where a great amount of air contained in the ink absorber 113 is supplied through the filter 111 due to the introduction of a large amount of air from the air communicating portion 114.

The recording head 101 and the exchange ink tank 107 are combined by joining a portion 116*a* of the ink tank to the carriage 115 using a pressure hook 116 of the carriage 115, as shown in FIG. 1.

An engaging hook 119 is disposed between the ink supply port and the head positioning portion 103 and resists a force applied through operation of the pressure hook 116 to permit the reliable connection of the ink supply passage under pressure. Since the pressure direction of the pressure hook 116 is set to be inclined at an angle of 10° for positioning the recording head 101 in the direction toward the recording paper with respect to the carriage 115, a component force F acts in the direction vertical to the direction of the combination between the recording head 101 and the exchange ink tank 107. In this embodiment, a projection 117 and a tank guide hole 118 engage each other also to produce a force in the direction vertical to the combination. Namely, an inclined surface of the projection 117 engages a wall of the tank guide hole 118, and the recording head 101 is positioned on the carriage 115 by the head positioning portion 103.

In this embodiment, the looseness of the passage 106 in the ink supply port 112 of the exchange ink tank 107 prevents application of a force to the passage 106, which is engaged directly with the discharge opening 109, so that high positional accuracy of the discharge opening in the recording head 101 is maintained. In addition, forces in the combination direction and the direction vertical thereto (component F) are received by the recording head at the tank guide hole 118. A vertical force is also produced in a direction opposite to the component F to force into contact the engaging hook 119 and an engaging guide 120 provided on the exchange ink tank 107. In this embodiment, the projection 117 also prevents rotation of the exchange ink tank 107 on the surface of the head base plate 112. In the embodiment shown in FIG. 1, the projection 117 is preferably provided at a position near the engagement of the pressure hook 116 with the ink tank 107 to prevent the application of a large force to the component members. It is matter of course that the tank guide hole 118 as a fulcrum is more preferably disposed at as large a distance as possible from the pressure means as the force point if the tank guide hole 118 can be disposed outside the pressure means. In this embodiment, a ring seal 122 comprises a somewhat thick elastic ring for obtaining side contact with the outer wall of the exchange ink tank 107 to seal the oversize ink supply port 112.

In FIG. 1, reference numeral 121 denotes a protection cover for protecting against damage the supply passage 106, reference numeral 124 denotes a head cover for protecting the recording head 101. The head cover will be described below with reference to FIG. 3. Reference numeral 125 denotes head driving electrodes.

Figure 2:
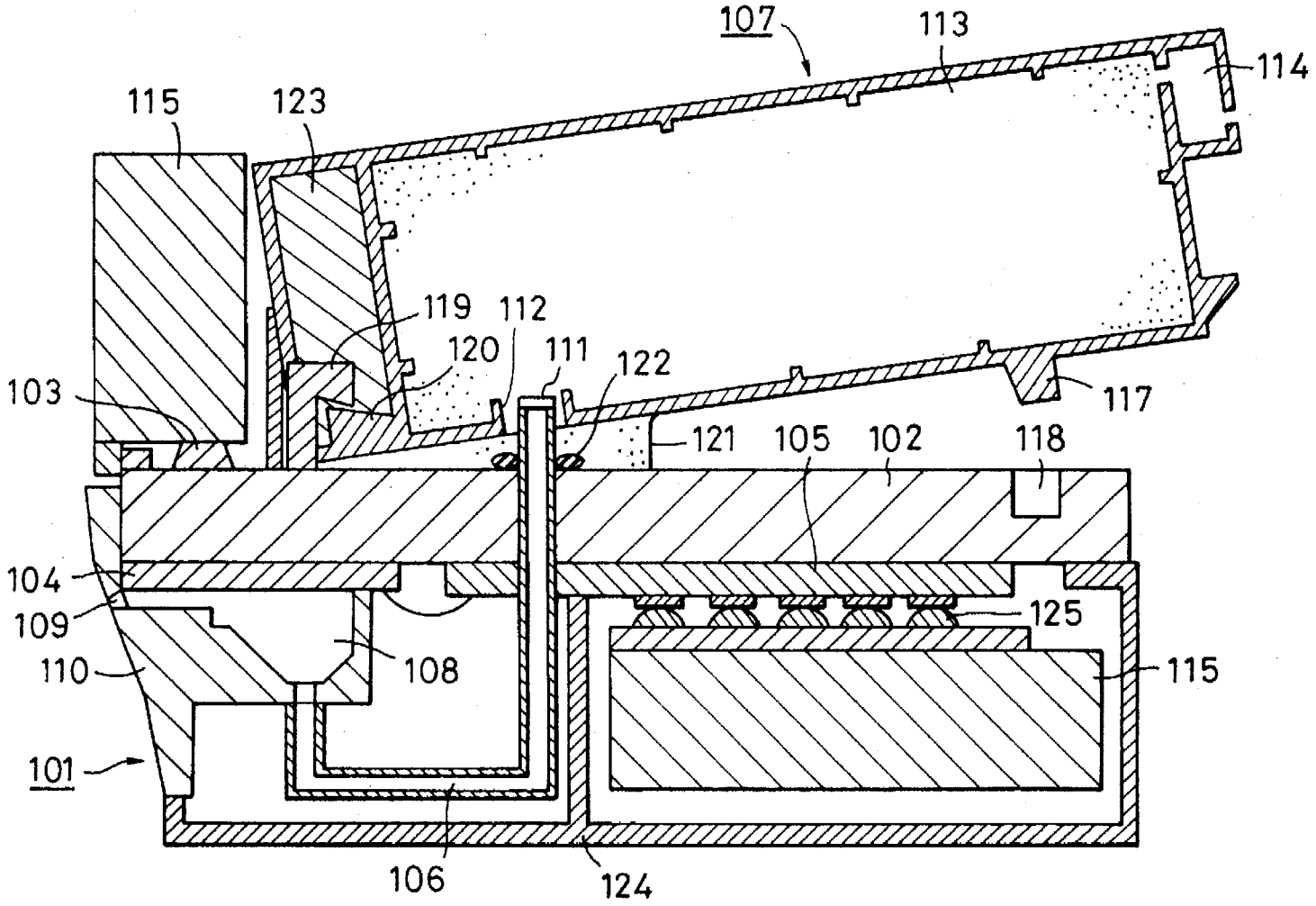
FIG. 2 is a schematic sectional view illustrating the procedure for mounting the recording head and the exchangeable ink tank shown in FIG. 1.

FIG. 2 illustrates the state where the recording head 101 and the exchange ink tank 107 are not pressed by the pressure hook 116, as they are in FIG. 1. In this state, the carriage 115, the recording head 101 and the exchange ink tank 107 can be separated, and only the engaging hook 119 contacts the engaging guide 120. In FIG. 2, the same portions as those shown in FIG. 1 are denoted by the same reference numerals, and are not described again.

Since the engaging hook 119 and the engaging guide 120 locate the recording head 101 and the ink tank 107, the ink absorber 113 properly contacts the end of the passage 106 having the filter as a contact surface without disturbing the passage 106, and the ink tank 107 can completely be sealed against the air by the ring seal 122. This is important because sufficient sealing causes introduction of air through the ring seal 122 into the ink tank during supply of the ink to the recording head 101, thereby causing difficulties in effectively utilizing the ink with which the ink absorber 113 is impregnated.

As described above with reference to FIGS. 1 and 2, in this embodiment, the recording head 101 and the exchange ink tank 107 are substantially combined on the carriage 115, and the exchange ink tank 107 is urged in one direction whereby the recording head 101 can be securely positioned and combined with the carriage 115, and at the same time, the recording head 101 can securely be combined with the exchange ink tank. In this embodiment, since the electrical connection between the carriage 115 and the recording head 101 is simultaneously performed, the exchange of the recording head 101 and the exchange ink tank 107 can be performed while maintaining good operating properties. The electrical connection may also be performed by a separate connector connection system so as to increase the ease with which the recording head 101 and the exchange ink tank 107 are both combined and securely positioned.

Figure 3:
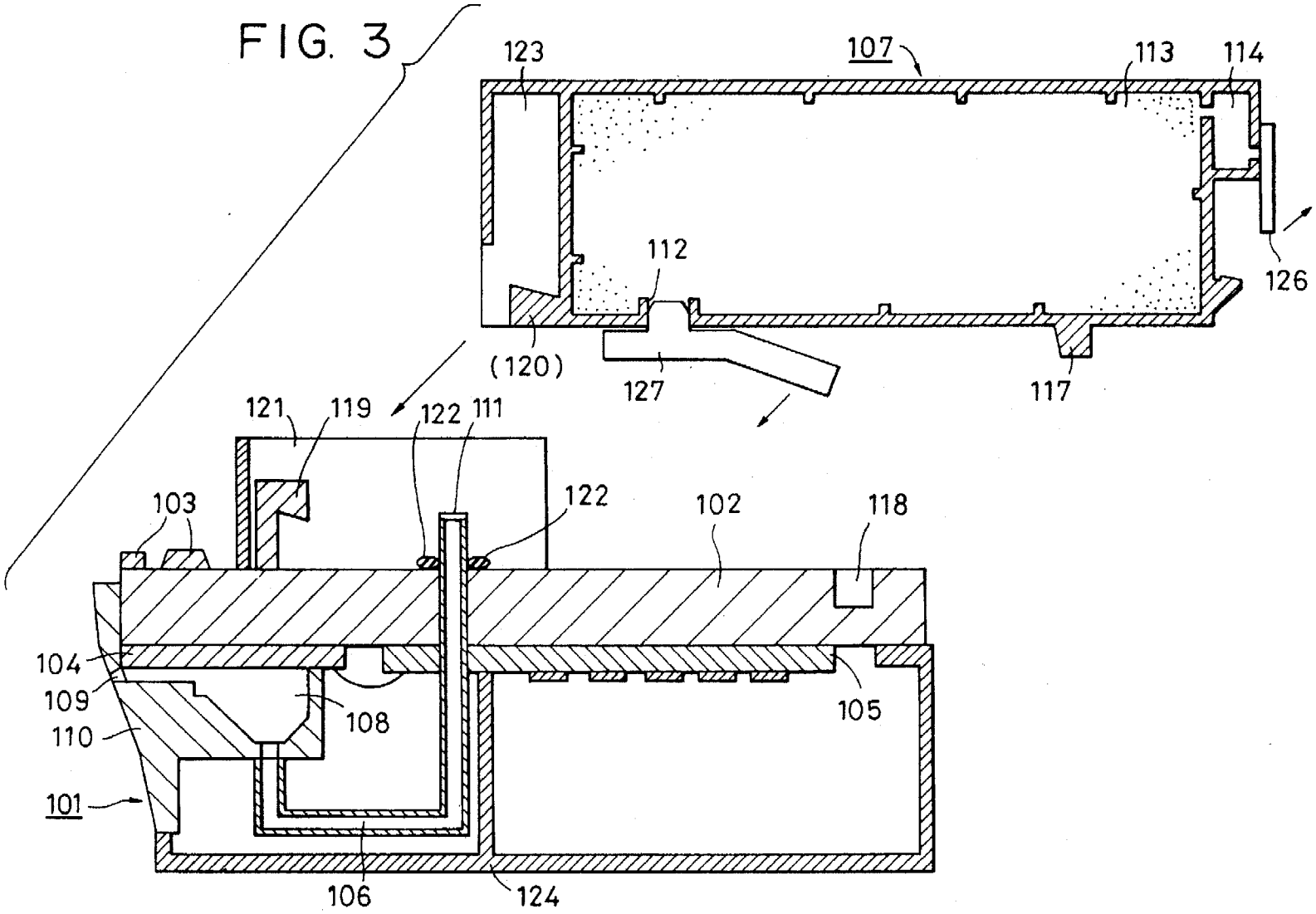
FIG. 3 is a schematic sectional view illustrating the state of the exchangeable ink tank and recording head shown in FIG. 1 before use.

FIG. 3 is a schematic sectional view illustrating the state of the exchange ink tank before use. In FIG. 3, the same reference numerals as those in FIG. 1 respectively denote the same component members, as in FIG. 2.

In FIG. 3, an air communicating portion seal 126 and a supply portion seal 127 are detachably provided on the air communicating portion 114 and the ink supply port 112, respectively. When the exchange ink tank 107 is used, these seals are removed in the directions shown by the arrows in FIG. 3.

As described above, the engaging guide 120 has the important function of locating the exchange ink tank 107 relative to the recording head 101 and also securing them together. The guide 120 is formed so as to project from the exchange ink tank 107 to engage it to perform its function. If the engaging guide 120 is deformed or damaged by an impact, for example, by dropping the ink tank 107 or mishandling it in an exchange of a used ink tank 107, the recording head can be improperly combined with the exchange ink tank 107, thereby causing leakage of ink. In the worst case, if the connection position between the passage 106 of the recording head 101 and the ink supply port of the exchange ink tank 107 is deviated, excessive force may be applied to the recording head 101 when force is applied by the pressure hook. This can damage or break the filter 111 or the passage 106 or the grooved top board 110, thereby creating the possibility that the recording head 101 cannot be used and must thus be replaced. In this embodiment, an engaging guide protecting cover 123 is provided on the exchange ink tank 107 in order to solve the above problem, as shown in FIG. 3. The engaging guide protecting cover 123 inevitably increases the size of the exchange ink tank 107. In this embodiment, however, the engaging guide protecting cover 123 is formed so as not to project from the carriage 115 on which the recording head 101 and the exchange ink tank 107 are mounted, and to overlap the component members of the recording head 101. It is thus possible to avoid an increase in the size of the recording apparatus body as much as possible. In addition, since the exchange ink tank 107 of this embodiment is relatively large, the engaging guide protecting cover 123 has little or no effect on the ease of handling of the ink tank. Further, since the engaging guide protecting cover 123 is provided solely for protecting the engaging guide, the shape of the package used for distribution of the exchange ink tank 107 is not substantially increase in size, and thus miniaturization of the package and efficiency of its distribution are little impaired.

A passage protecting cover 121 is also provided on the side of the recording head 101 so as to protect the ink supply passage 106 and the engaging hook 119 when handling the recording head 101, thereby preventing the application of unnecessary force to those components, as shown in FIG. 3. A removable protecting seal can be provided on the upper surface of the passage protecting cover 121 for preventing access of foreign materials such as dust to the filter 111. Since the protecting cover 121 is formed so as to partly overlap the outside of the external wall of the exchange ink tank 107, as in the engaging guide protecting cover 123, there is substantially no increase in the size of the recording apparatus body. Namely, this embodiment can avoid potential problems with respect to using a separate exchange ink tank 107 and recording head 101 and their handling, without substantially increasing the size of the recording apparatus when the head and ink tank are mounted. This embodiment thus improves the reliability of the ink jet recording apparatus of the type in which the ink tank and the recording head can be separately exchanged.

Although this embodiment has been described in connection with a monochromatic recording apparatus having a single recording head, it can be applied to a color ink jet recording apparatus having a plurality of recording heads which can discharge ink droplets of different colors, e.g., four recording heads of Bk (black), C (cyan), M (magenta)

and Y (yellow), and recording means which can discharge ink droplets of plural colors by using a single recording head. In a plural recording head case, a mechanism may be added for restricting the combination position and direction of the exchange ink tank 107, that is, for ensuring the proper recording head is combined with the proper ink tank.

As described above, in this embodiment, the direction of combination between the carriage and the recording head is substantially the same as that direction of combination between the recording head and the exchange ink tank, and the exchange ink tank is urged to the carriage. Thus, the recording head and the exchange ink tank can be exchanged with good operating properties, and the mechanical and electrical connections can securely be made by a simple structure.

Figure 4:
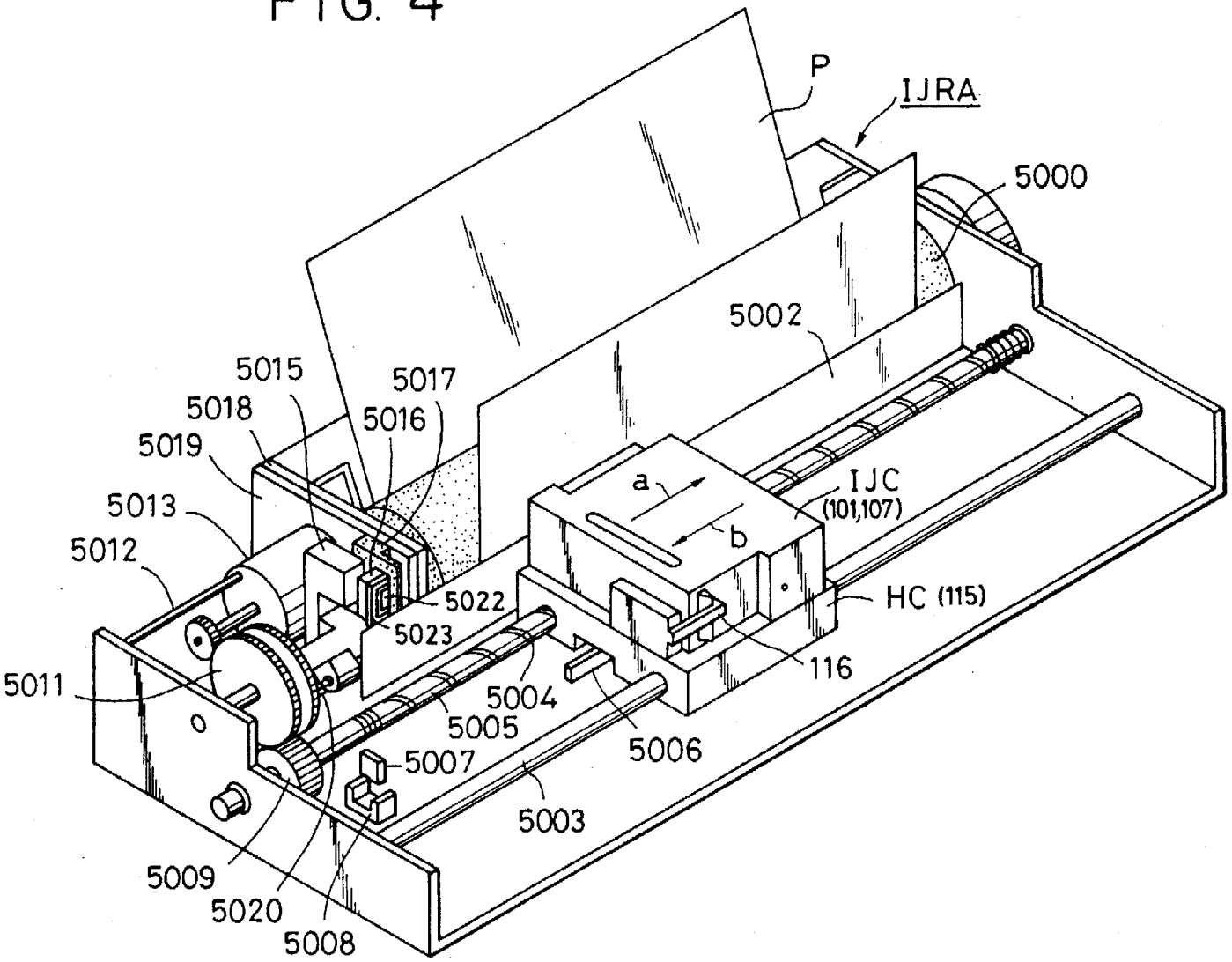
FIG. 4 is a perspective view illustrating an ink jet recording apparatus to which the present invention can be applied.

FIG. 4 is a perspective view of an ink jet recording apparatus IJRA provided with an ink jet cartridge IJC (101, 107) in which the recording head 101 and the ink tank 107 can be exchanged, as shown in FIGS. 1 to 3.

In FIG. 4, a recording medium P is upwardly guided by a platen roller 5000, and is pressed on the platen roller 5000 by a paper pressure plate 5002 in the direction of movement of a carriage HC (115). The carriage HC is laterally reciprocated along the recording surface of the recording medium P, which is guided to the platen roller 5000, by rotation of the driving pin provided in the carriage HC and engaged with a helical groove 5004. The carriage is engaged and supported by a lead screw 5005, having therein the helical groove and thus operating as a driving source, and a slider 5003 disposed in parallel with the lead screw 5005. The rotation of the lead screw 5005 is controlled in linkage with the normal and reverse rotations of a driving motor (not shown) through driving transmission gears 5011 and 5009. Reference numerals 5007 and 5008 each denote a photocoupler as home position detection means for ensuring that a lever 5006 of the carriage HC is present in the home position region to switch the rotation direction of a motor 5013. When an image record signal is transmitted to the recording head in timing with the movement of the carriage HC on which the recording head is mounted, ink droplets are discharged to the recording medium P at a predetermined position to record an image. Reference numeral 5016 denotes a member for supporting a cap member 5022 for capping the front side of the recording head, and reference numeral 5015 denotes suction means for sucking the ink of the capping member 5022 to perform suction recovery of the recording head through the opening 5023 in the cap. Reference numeral 5017 denotes a cleaning blade, and reference numeral 5019 denotes a member for permitting forward and backward movement of the cleaning blade 5017, the cleaning blade 5017 and the member 5019 being supported by a body support plate 5018. The suction means 5015, the cleaning blade 5017, etc. are not limited to this structure, and any known form thereof can be used. Reference numerals 5012 denotes a lever for determining the timing of the suction recovery operation. The lever 5012 is moved with movement of a cam 5020 which engages the carriage HC, and the movement of the lever 5012 is controlled by known transmission means such as a clutch or the like for switching the driving force from the driving motor. The recovery means is constructed so as to perform desired processing by the operation of the lead screw 5005 at a position corresponding thereto with desired timing when the carriage reaches the home position region.

(Embodiment 2)

Figure 5:
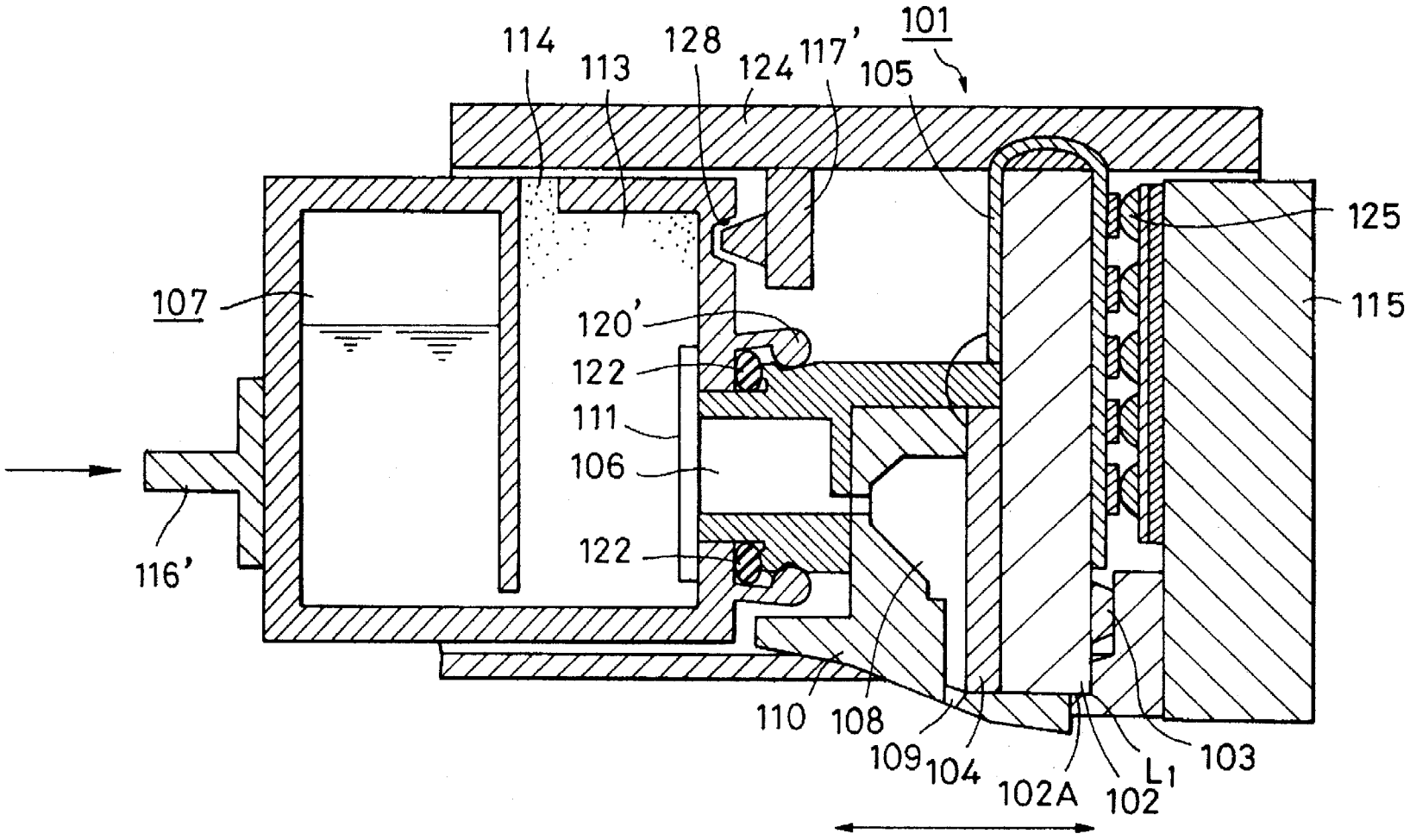
FIG. 5 is a schematic sectional view illustrating a second embodiment of the present invention.

FIG. 5 is a schematic sectional view illustrating the state where a recording head, an exchange ink tank and a carriage are combined in accordance with a second embodiment of the present invention.

In FIG. 5, the same reference numerals as those of Embodiment 1 denote portions having the same functions, and are not described below.

In this embodiment, ink droplets are downwardly discharged onto the upper surface of a recording medium (not shown) from the discharge opening 109 to record an image by scanning. Positioning of the recording head 101 with respect to the carriage 115 in the direction toward the paper surface is achieved by pressure contact between a notch portion 102A of the head base plate 102 and a projection reference position $L_1$ of the head positioning portion 103 using the weight of the recording head 101.

In this embodiment, electrical connection is achieved by pressure contact between the head driving electrodes 125 provided on the carriage 115 and the pads of the PCB 105 using the pressure applied through the exchange ink tank 107, as in Embodiment 1. However, in this embodiment, since the electric wiring of the recording head 101 is provided on a flexible substrate having excellent flexibility, and the pressure contact pads are provided on the surface of the head base plate 102 opposite to the discharge opening 109 of the recording head 101, the reliability of electrical connection is improved as compared with Embodiment 1, in which the recording head 101 must be slightly rotated for mounting.

A positioning reference projection (not shown) is also provided near the electrode portion at the rear end of the head base plate 102 in order to prevent the recording head 101 from being obliquely mounted. In addition, a layer having a larger thickness and higher elasticity than Embodiment 1 is provided underneath the head driving electrodes 125 so as to obtain appropriate contact pressure between the PCB 105 and the head driving electrodes 125. Namely, in this embodiment, the pressure applied to the recording head 101 from the exchange ink tank 107 in the direction of the arrow shown in FIG. 5 is received by the reference projections provided in front of and behind the head base plate 102.

Figure 6:
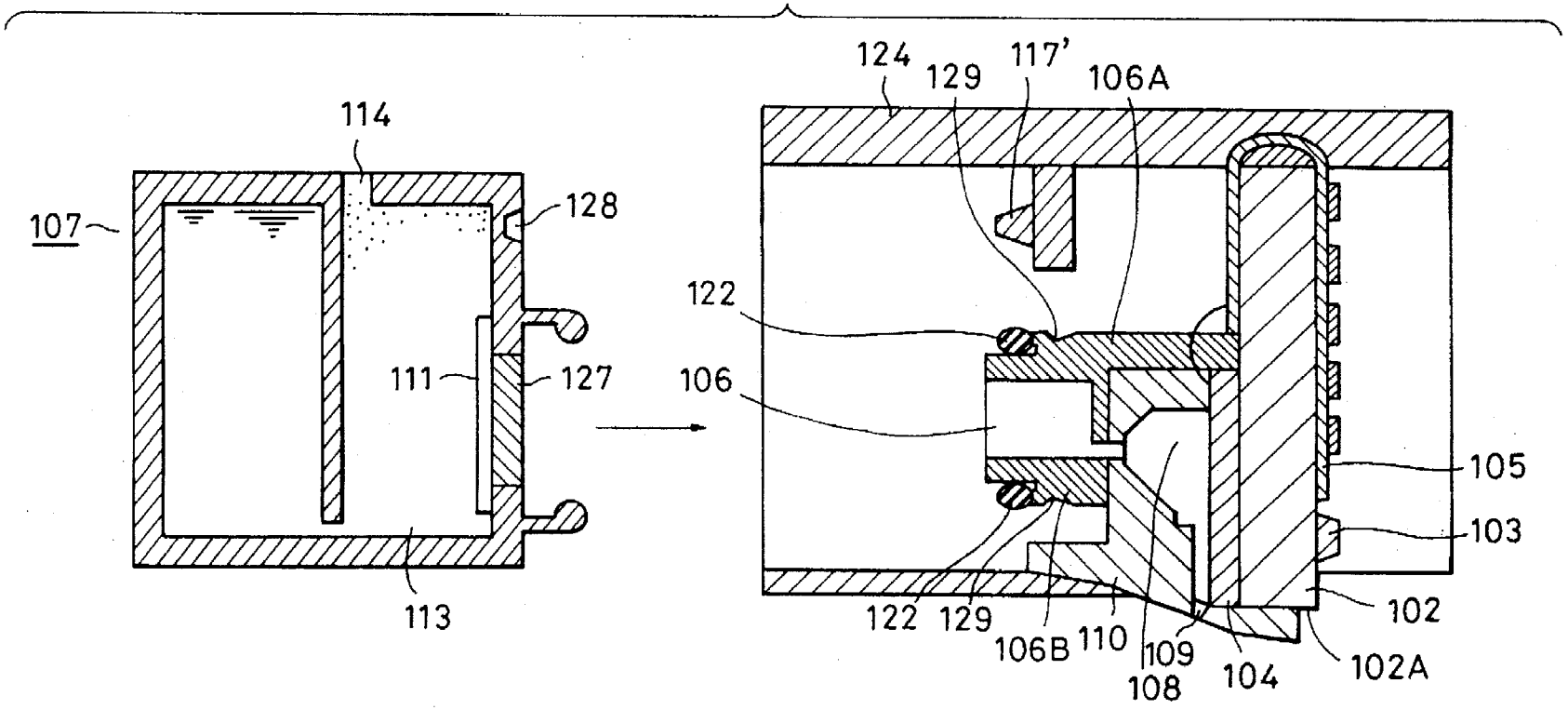
FIG. 6 is a schematic sectional view illustrating the procedure for mounting the recording head and the exchangeable ink tank shown in FIG. 5.

In this embodiment, unlike Embodiment 1, the passage 106 is provided adjacent to the liquid chamber 108, on the left side thereof as seen in FIGS. 5 and 6. This avoids the passage 106 needing to pass through the head base plate 102, and thus permits the passage 106 to be made short and thick, and thus sturdier, unlike Embodiment 1. This makes it possible to decrease the pressure loss in the supply of the ink to the recording head and thus improve recording frequency.

On the other hand, since pressure is easily applied to the discharge opening 109 through the passage 106 when the exchange ink tank 107 and the recording head 101 are combined, the mechanical strength of a passage forming member 106A which forms the passage 106 is increased so that the passage forming member 106A is fixed and supported directly on the head base plate 102. In this case, sufficient sealing properties of the connection between the passage 106 and the liquid chamber 108 can be achieved by using a sealant.

The recording head 101 may comprise a heater board 104 and a grooved top board 110 which are laminated on the heat base plate 102 so as to supplement the combining strength by appropriately adjusting the pressure applied through the exchange ink tank 107.

FIG. 6 is a schematic sectional view illustrating a state in which the exchange ink tank and the recording head are separated.

Mounting of the recording head 101 and the exchange ink tank 107 is achieved by moving the exchange ink tank 107 in the arrow direction shown in the drawings while sliding the surface of the exchange ink tank 107 on the side of the air communicating portion 114 on the head cover 124 of the recording head 101 to combine engaging guides 120' and a recessed portion 129. The external wall of the exchange ink tank 107 may be ribbed for improving the sliding property between the head cover 124 and the surface of the exchange ink tank 107 on the side of the air communicating portion 114. The tank guide projection 117' has the function of substantially restricting the rotation of the exchange ink tank 107 relative to the recording head 101 by engaging a recessed portion 128 on the exchange ink tank 107.

The engaging guides 120' on the exchange ink tank 107 are elastically deformable and engage the recessed portion 129 of the passage forming member 106A supported by the head base plate 102 of the recording head. The end of each of the engaging guides 120' is rounded for facilitating mounting. In this embodiment, three engaging guides 120' (one being not shown) are provided so that the engagement portions contact the cylindrical passage forming member 106A at three points. Other engaging guides may be further provided, or the engaging guide may be formed in a cylindrical shape of non-cylindrical shape. It is preferable for facilitating mounting and removal that the engaging guides 120' are not rigid. In the state shown in FIG. 6, the ring seal 122 might be only partially deformed and the filter 111 might insufficiently contact the ink absorber 113. However, the combining strength of the connection provided by the engaging guides may be sufficient to permit integral handling of the recording head 101 and the exchange ink tank 107 even through they are not mounted on the carriage.

In this way, when the exchange ink tank 107 is pressed in the arrow direction shown in FIG. 5, the recording head 101 is securely contact-bonded and fixed to the carriage, and is securely combined with the exchange ink tank 107. In other words, as shown in FIG. 5, the engaging guides 120' of the exchange ink tank 107 are inserted to a position inward of the recessed portion 129 of the passage forming member 106A. This causes the filter at the end of the passage 106 to sufficiently adhere to the ink absorber 113 for supplying the ink when the exchange ink tank 107 is combined with the recording head 101, and the ring seal 122 to be elastically deformed until the outer wall of the exchange ink tank 107 contact the upper surface at the end of the passage 106, thereby completely preventing entrance of air in the passage 106 through the connection portion. Even in this state, the tank guide 117' is positioned with a sufficient gap 128 between the recording head 101 and the recessed portion 128 of the exchange ink tank 107 so as to prevent unnecessary force from acting on the connection portion where the ink is supplied to the passage 106 through the filter 111.

As described above, this embodiment is constructed so that the head cover 124 of the recording head 101 partly covers the upper side of the exchange ink tank 107 after the recording head 101 is combined with the exchange ink tank 107. The head cover 124 also protects the ink passage 106 when the head and tank are not combined, and protects the printed circuit board. The latter helps avoid electrostatic breakage of the printed circuit board during exchange of the recording head 101 and poor electrical connection caused by adhesion of foreign materials to the electrodes. In regard to protection of the printed circuit board, since the carriage 115 is partly overlapped the head cover 124 and integrated therewith when the recording head is combined with the ink jet recording apparatus body, as shown in FIG. 5, miniaturization of the recording head apparatus can be realized.

In this embodiment, the exchange ink tank 107 is divided into two chambers, one of which contains ink and the other of which communicates with the first ink chamber at the bottom thereof and is filled with an ink absorber for adjusting capillary force. In Embodiment 1, since the exchange ink tank 107 is filled with the ink absorber alone, the amount of impregnation thereof with in is limited. However, in this embodiment, since the exchange ink tank 107 is divided into the two chambers, the ink can be contained in an amount larger than the amount allowed with use of the ink absorber 113, thereby increasing the utilization of the ink.

(Embodiment 3)

Figure 7:
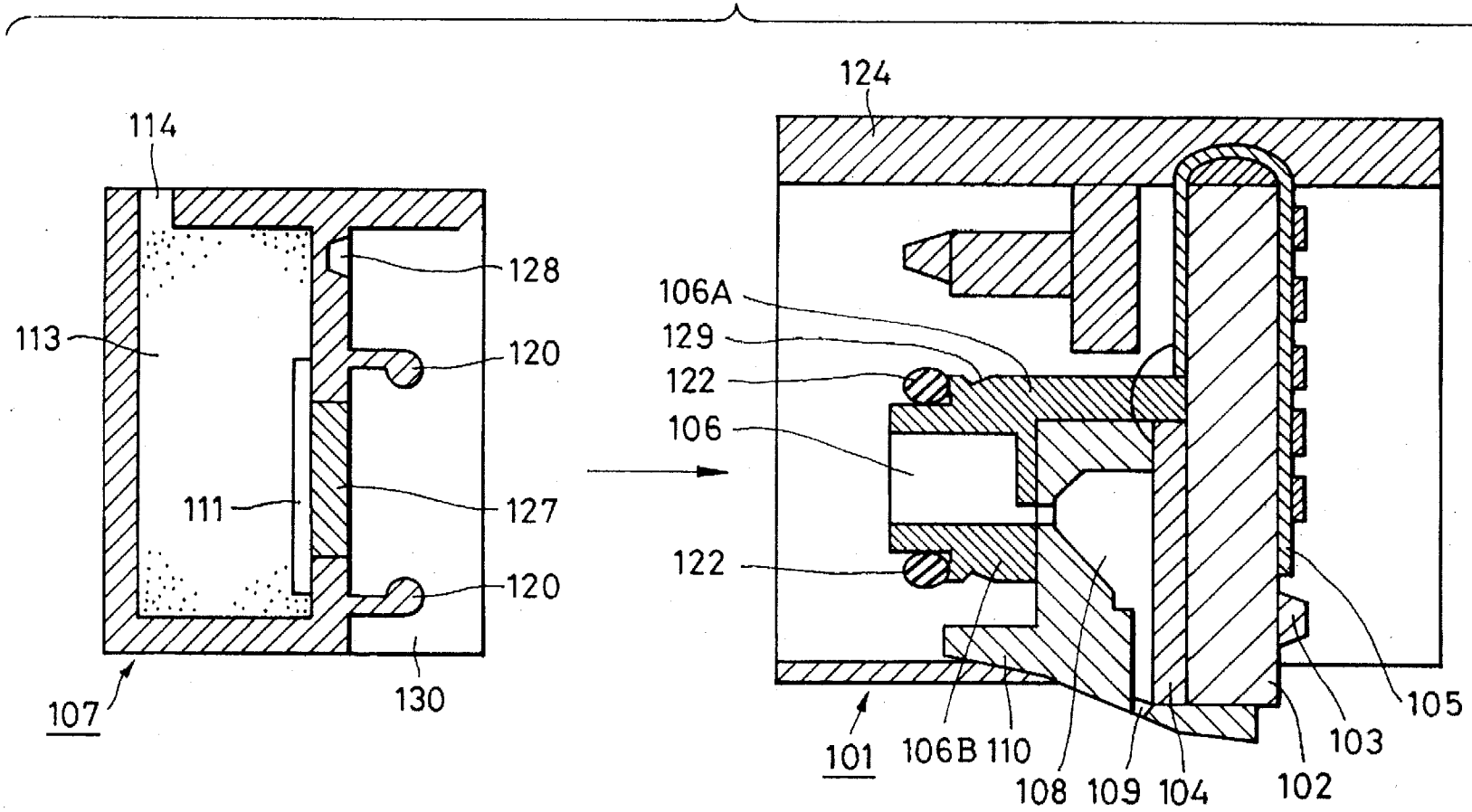
FIG. 7 is a schematic sectional view illustrating a third embodiment of the present invention.

FIG. 7 is a schematic sectional view illustrating an ink jet recording apparatus in accordance with a third embodiment of the present invention.

In FIG. 7, a recording head 101 has the same structure as that shown in FIGS. 5 and 6 with exception that only an ink chamber containing the ink absorber 113 is provided in the exchange ink tank 107, without an ink chamber for storing the ink.

This decreases the size of the exchange ink tank 107, as compared with Embodiment 2, thereby permitting further miniaturization of the body of the ink jet recording apparatus. In this embodiment, the decrease in the size of the exchange ink tank 107 facilitates handling at the time of exchange. A tank cover 130 is provided on the side of the exchange ink tank 107 so as to be smaller than the size of the actual ink tank. Since the tank cover 130 is partly overlapped with the recording head 101 when the exchange ink tank 107 is combined with the recording head 101, ease of handling can be improved without interfering with miniaturization of the body of the ink jet recording apparatus.

As described above, the present invention permits exchange of the recording head and the ink tank by using the engaging guides, thus improves the operating properties of exchange of the recording head and the ink tank, and facilitates mechanical and electrical connections.

Further, in the present invention, even if the recording head is not mounted on the carriage of the ink recording apparatus, since the recording head and the ink tank are substantially integrally formed, and partly overlap each other by virtue of the head cover, the recording head printed circuit board and the electrodes are protected without increasing the size of the ink jet recording head. This can improve the reliability of the ink jet recording apparatus.

What is claimed is:

1. An ink jet head of an ink jet cartridge removably mounted on a carriage of an ink jet apparatus and in which said ink jet head and an ink tank are separable from each other, said ink jet head comprising:

a head portion having a discharge opening for discharging ink, an ink guide tube to guide ink from said ink tank to said head portion for discharge from said discharge opening and to be connected with said ink tank, an electrode portion to receive a recording signal to be inputted in order to discharge ink from said discharge opening, a first engaging member to be engaged with a first engaging portion provided in said ink tank and to secure a linking state of said ink tank and said ink jet head, and a protective member to enclose and protect said ink guide tube and said first engaging member.

2. An ink jet head according to claim 1, wherein said ink jet head further comprises a cover to protect said electrode portion.

3. An ink jet head according to claim 2, wherein a cover for protecting said electrode portion has a portion to partially overlap with said carriage.

4. An ink jet head according to claim 1, wherein said ink jet apparatus comprises an engaging fixing member to fix said ink jet cartridge on said carriage, and said ink tank further comprises a second engaging portion to be engaged with said engaging fixing member.

5. An ink jet head according to claim 4, wherein the force of action by said engaging fixing member to engage and fix said ink tank operates in a direction to secure connection of said electrode portion of said ink jet head with an electrode of said carriage.

6. An ink jet head according to claim 1, wherein said ink tank further comprises a third engaging portion to be engaged with a part of said ink jet head.

7. An ink jet head according to claim 1, wherein said ink tank comprises an air communication portion to communicate the inside of said ink tank with its outside.

8. An ink jet head according to claim 7, wherein said air communication portion of the ink tank is installed in a position inside of a region surrounded by said protective member in a state of being linked with said ink jet head.

9. An ink jet head according to claim 1, wherein said ink jet head comprises a heater and discharges ink by bubbles generated by heating according to input of a recording signal.

10. An ink jet head according to claim 1, wherein said ink jet head comprises a second engaging member to position said ink jet head with respect to said carriage.

11. An ink jet head according to claim 1, wherein said ink tank has a protective cover member for protecting said first engaging member.

12. An ink jet head according to claim 11, wherein said protective cover member has a portion to partially overlap with a protective member in said head portion, in a state that said head portion and said ink tank are linked with each other.

* * * * *

UNITED STATES PATENT AND TRADEMARK OFFICE

CERTIFICATE OF CORRECTION

PATENT NO. : 5,671,000

DATED : September 23, 1997

INVENTOR(S) : HIROMITSU HIRABAYASHI ET AL

It is certified that error appears in the above-indentified patent and that said Letters Patent is hereby corrected as shown below:

ON TITLE PAGE, AT [56]

After "Primary Examiner-N.Le" insert --Attorney, Agent, or Firm-Fitzpatrick, Cella, Harper & Scinto--

ON TITLE PAGE, AT [56], FOREIGN PATENT DOCUMENTS

"4247954" should read --4-247954--.

ON TITLE PAGE, AT [57], ABSTRACT

Line 10, "link" should read --ink--.

COLUMN 1

Line 41, "an" should read --and;
Line 43, "coat" should read --cost--;
Line 46, "to" should read --so--.

COLUMN 2

Line 27, "reliable" should read --reliably--;
Line 55, "removable" should read --removably--;
Line 59, "i" should read --in--.

COLUMN 3

Line 18, "EMBODIMENT" should read --EMBODIMENTS--;
Line 41, "board 014" should read --board 104--;
Line 44, "to" should read --top--;
Line 51, "to" should read --top--.

COLUMN 6

Line 39, "increase" should read --increased--.

UNITED STATES PATENT AND TRADEMARK OFFICE

CERTIFICATE OF CORRECTION

PATENT NO. : 5,671,000

DATED : September 23, 1997

INVENTOR(S) : HIROMITSU HIRABAYASHI ET AL

It is certified that error appears in the above-indentified patent and that said Letters Patent is hereby corrected as shown below:

COLUMN 7
Line 54, "numerals" should read --numeral--.

COLUMN 8
Line 59, "heat" should read --head--.

COLUMN 9
Line 22, "of" should or --or--;
Line 43, "contact" should read --contacts--;
Line 46, "128" should be deleted.

COLUMN 10
Line 5, "with in" should read --within--;
Line 14, "exception" should read --the exception--.

Signed and Sealed this

Seventh Day of July, 1998

Bruce Lehman

*Attest:*

BRUCE LEHMAN

*Attesting Officer*

*Commissioner of Patents and Trademarks*